US006976544B2

(12) United States Patent
Sundholm

(10) Patent No.: US 6,976,544 B2
(45) Date of Patent: Dec. 20, 2005

(54) SPRINKLER

(75) Inventor: Göran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 180 days.

(21) Appl. No.: 10/479,697

(22) PCT Filed: Jun. 18, 2002

(86) PCT No.: PCT/FI02/00534

§ 371 (c)(1),
(2), (4) Date: Dec. 5, 2003

(87) PCT Pub. No.: WO02/102462

PCT Pub. Date: Dec. 27, 2002

(65) Prior Publication Data

US 2004/0144549 A1 Jul. 29, 2004

(30) Foreign Application Priority Data

Jun. 19, 2001 (FI) ..... 20011300

(51) Int. Cl.[7] ..... A62C 37/08; A62C 37/00; A62C 37/12

(52) U.S. Cl. ..... 169/42; 169/37; 169/38; 169/41; 169/19; 169/26; 169/56; 169/57

(58) Field of Search ..... 169/41, 42, 19, 169/37, 38, 26, 56, 57, 59, 60

(56) References Cited

U.S. PATENT DOCUMENTS 4,664,198 A * 5/1987 Johnson ..... 169/38
4,715,447 A * 12/1987 Johnson ..... 169/37
4,880,063 A * 11/1989 Leininger et al. ..... 169/37
5,188,185 A * 2/1993 Mears ..... 169/37
5,513,708 A 5/1996 Sundholm
5,944,113 A 8/1999 Sundholm
6,230,815 B1 5/2001 Sundholm
6,345,670 B1 * 2/2002 Sundholm ..... 169/37

FOREIGN PATENT DOCUMENTS

WO 9531252 A1 11/1995

* cited by examiner

*Primary Examiner*—Davis Hwu
(74) *Attorney, Agent, or Firm*—Ladas and Parry LLP

(57) ABSTRACT

A sprinkler comprising a temperature-activated means (1), a housing (2), a central nozzle (4), a side nozzle (5*a*, 5*b*), a first channel (9-15-6-12-13) for guiding a medium to the central nozzle, and a second channel (9-15-17-14-7*a*) for guiding the medium to the side nozzle, the second channel being closed with a spindle means (8) while the sprinkler is in its standby state. To provide a sprinkler for implementing a fire fighting apparatus that extinguishes efficiently at the fire site, even though hot combustible gases were spread far from the fire site to cause the triggering of sprinklers far from the fire site, the spindle means (8) comprises a first spindle part (8*a*) having a first action surface area (A1) exposed to the pressure of the medium after the temperature-activated means (1) is triggered and an additional surface area (A2) that comes under at least a first pressure of the medium when the first spindle part (8*a*) moves from a first position, in which only the first channel is open (9-15-6-12-13), to a second position, in which the first and the second channel (9-15-17-14-7*a*) are open.

13 Claims, 2 Drawing Sheets

SPRINKLER

BACKGROUND OF THE INVENTION

The invention relates to a heat-triggered sprinkler used in fire fighting. More specifically, the invention relates to a sprinkler comprising a temperature-activated means, a housing, an inlet for a medium, a central nozzle, at least one side nozzle, a first channel for guiding the medium from the inlet to the central nozzle while the sprinkler is in its active state, and a second channel for guiding the medium from the inlet to said at least one side nozzle, the second channel being closed by means of a spindle means while the sprinkler is in a standby state, which spindle means, in the sprinkler's standby state, is in a housing channel of the housing in a first position, in which it is arranged to keep the second channel closed, and which spindle means, when the sprinkler is being activated due to the heat-activating means reacting to heat, is arranged to move to a second position and to open the second channel.

A sprinkler of the type described above is known from published international patent no. WO 95/31252. This known sprinkler is of a type, in which all its nozzles spray an extinguishing medium when the sprinkler transfers from its standby state, in which the temperature-activated means (ampoule) is intact, to its active state after the temperature-activated means breaks due to heat. After the temperature-activated means breaks, all the nozzles continue spraying as long as the extinguishing medium is fed into the inlet of the sprinkler.

The use of this known sprinkler in a fire extinguishing apparatus is normally problem-free. However, if this known sprinkler is used in applications, in which it is possible that hot combustible gases move far from the fire site because of airflows, the sprinklers transfer in the normal manner to said active state after the temperature-activated means has broken. The danger then exists that a great deal of the fire-extinguishing medium is sprayed on locations that do not need it. This unnecessarily sprayed extinguishing medium decreases the output of the spray nozzles close to the fire site, because the pressure of the extinguishing medium decreases below the design pressure of the fire extinguishing apparatus and/or the extinguisher fluid tank is emptied quicker than designed. Examples of such applications are tunnels, such as tunnels for vehicles. When sprinklers that are far from the fire site spray, the actual fire site does not receive the full output and there is a danger that the fire fighting fails or is inefficient with unfortunate results.

BRIEF DESCRIPTION OF THE INVENTION

It is an object of the invention to provide a sprinkler that eliminates or at least reduces substantially the above-mentioned drawback. To achieve this, the sprinkler of the invention is characterized in that the spindle means comprises a first spindle part which, when it is in a first position, is arranged to keep the second channel closed while the sprinkler is in its standby state, which first spindle part comprises a first action surface area that is exposed to the pressure of the medium after the temperature-activated means of the sprinkler is triggered and while the sprinkler is in its active state, and which first spindle part, when the temperature-activated means of the sprinkler is triggered, is arranged to move against the spring-back force of a spring from the first position to a second position in such a manner that it opens the second channel as a result of the medium directing to the first action surface area at least a first pressure, and that the first spindle part comprises an additional surface area that is exposed to said at least first pressure of the medium when the first spindle part moves from its first position to its second position, the size of the additional surface area being selected so that it, as a result of the pressure of the medium, keeps the first spindle part in said second position when the pressure of the medium is above a second pressure, which second pressure is substantially lower than the first pressure, whereby after the temperature-activated means is triggered, the sprinkler is in a first active state when the first spindle part is in its second position and in a second active state when the first spindle part is in its first position. The first pressure can be called an opening pressure. If, when the temperature-activated means is triggered, a pressure lower than the first pressure is directed to the first action surface area, the first spindle part does not move, but the first channel opens and the medium flows to the central nozzle only and the sprinkler is in its second active state. The sprinkler then sprays at a reduced output, and as a result of this, the sprinklers that are close to the fire site and in the first active state are able to continue spraying at a high power even if the pressure had decreased to a relatively low level.

When the first pressure is selected to be relatively high, for instance 50 bar, the triggering of the temperature-activated means in the sprinklers that are far from the fire site causes in practice that in these sprinklers assuming that the pressure of the fire extinguishing apparatus has already due to the triggered sprinklers decreased to a level below 50 bar—only the central nozzles spray. The sizes of the first action surface area and the additional surface area and the force of the spring are selected to obtain the desired operation of the sprinkler.

When the size of the additional surface area is selected in such a manner that the second pressure is substantially lower than the first pressure (typically at most half of the first pressure), the sprinkler that is already in its first active state continues to spray with all its nozzles, even though the pressure of the extinguishing medium, for instance as a result of the triggering of the rest of the sprinklers, is significantly lower.

Preferred embodiments of the sprinkler of the invention are described in the attached claims 2 to 13.

The greatest advantage of the sprinkler of the invention is that by means of it, it is possible to provide a fire fighting apparatus that produces a great extinguishing power even if hot combustible gases were spread far from the fire site to cause the triggering of the sprinklers far from the fire site.

BRIEF DESCRIPTION OF THE FIGURES

The invention will now be described in greater detail by means of a preferred embodiment and with reference to the attached drawing illustrating an embodiment of the sprinkler of the invention, in which.

DETAILED DESCRIPTION OF THE INVENTION

Figure 1:
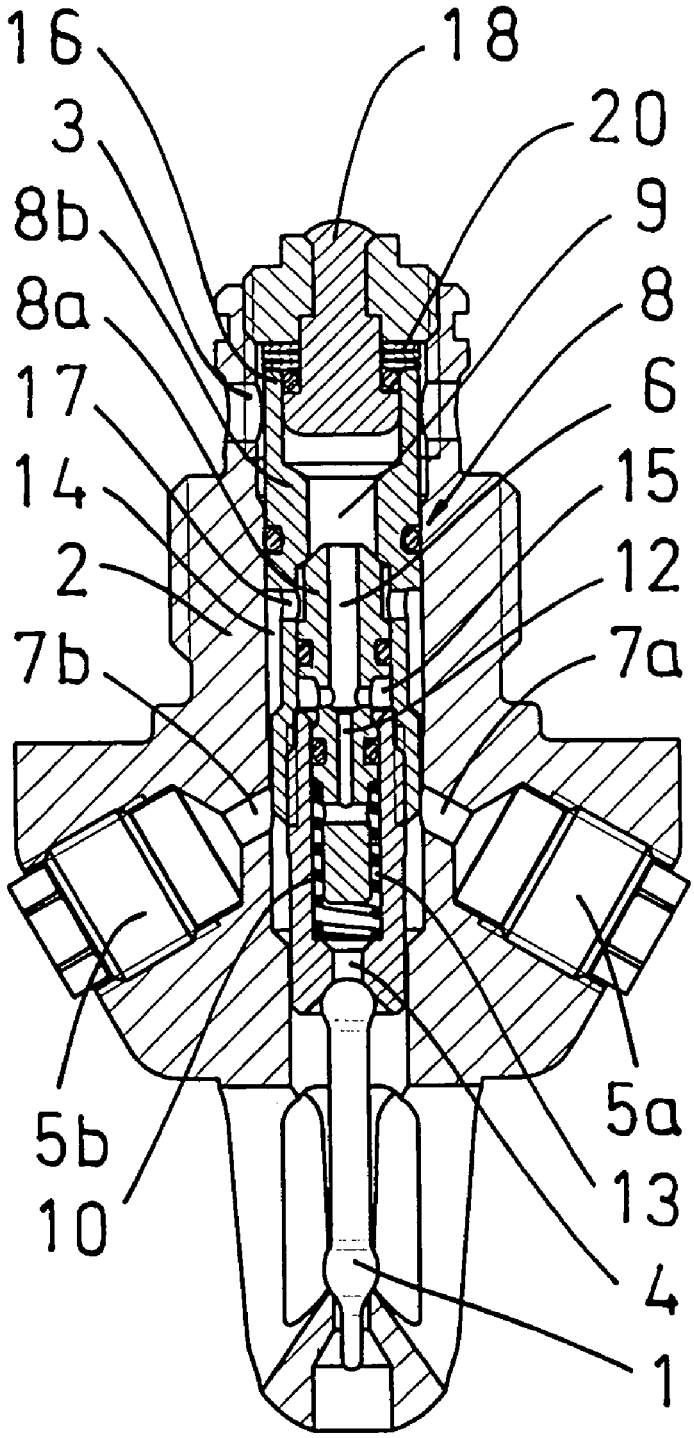
FIG. 1 shows the sprinkler in its standby state.

The sprinkler shown in FIG. 1 comprises a housing 2 with an inlet 3 for a medium, a central nozzle 4, four side nozzles 5*a*, 5*b* (only two shown in the figure), and a temperature-activated means in the form of a glass ampoule 1. Instead of the glass ampoule 1, the temperature-activated means can be some other heat-activating means, such as a metal that melts at a low temperature.

Reference numeral 8 generally marks a spindle means that is arranged to move in a housing channel 14 in the housing. The movement of the spindle means 8 will be described later. The spindle means 8 comprises a first spindle part 8*a* and a second spindle part 8*b* moving in relation thereto. The first spindle part 8*a* is arranged loaded by a spring 10 inside a spindle channel 15 in the second spindle part 8*b*. The spindle channel 15 comprises a narrower section marked with reference numeral 9 and having a diameter that is smaller than that of the top of the first spindle part 8*a*. When the sprinkler is in its standby state, the top of the first spindle part 8*a* closes the spindle channel 15 in such a manner that the spindle channel is not open to the housing channel 14. The wall of the second spindle part 8*b* has openings 17 through which the spindle channel 15 is connected to the housing channel 14 when the sprinkler is in the active state shown in FIG. 2. A sleeve-like part 16 at the top of the second spindle part 8*b* is arranged to close the inlet 3 when the sprinkler is in the standby state shown in FIG. 1, in which the glass ampoule 1 is intact. The top of the sleeve-like part 16 is closed with a plug 18 and the diameter of the sleeve-like part in the housing channel 14 remains the same or nearly the same on both sides of the inlet 3 in such a manner that the pressure of the medium in the inlet does not cause the spindle means 8 to cause a force directed towards the ampoule 1—or causes at most a small force directed towards the ampoule. Instead of the plug 18, the housing may be closed at its top in an integrated manner. The plug 18 provides the advantage that it makes the structure of the sprinkler relatively simple and the assembly of the sprinkler easy.

From the inlet 3 of the sprinkler, there is a channel 9-15-6-12-13 to the central nozzle 4 and channels 9-15-17-14-7*a* and 9-15-17-14-7*b* to the side nozzles 5*a*, 5*b*. The channel mentioned first can be called the first channel and the ones mentioned second the second channels.

When the ampoule 1 of the sprinkler in FIG. 1 is triggered, the spindle means 8 moves downward due to gravity. If the sprinkler is not vertical in the position of the figure, said movement of the spindle means 8 can be provided by cup springs 20 arranged at the top of the spindle means and/or by making the geometry of the spindle means such that it comprises a sufficiently large projection surface area susceptible to the pressure of the medium that under the effect of the medium produces to the spindle means a force directed towards the ampoule 1. The projection surface area is in the direction of travel of the spindle means 8 the projected area that is perpendicular to the direction of travel of the spindle means.

Figure 2:
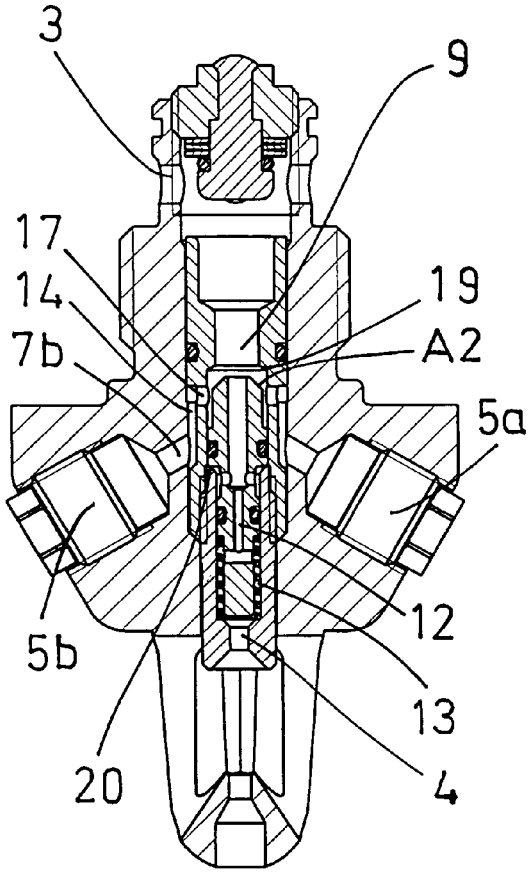
FIG. 2 shows a triggered sprinkler in its first active state.
Figure 3:
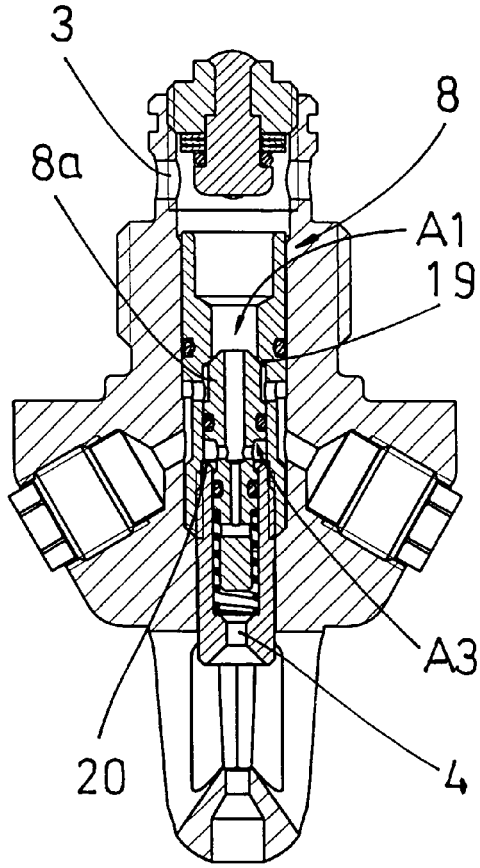
FIG. 3 shows a triggered sprinkler in its second active state.

When the sprinkler is triggered, it transfers depending on the size of the pressure of the medium either to the first active state shown in FIG. 3, in which only the central nozzle 4 sprays, or to the second active state shown in FIG. 2, in which all nozzles 4, 5*a*, 5*b* spray. The transfers of the sprinkler are described in more detail in the following.

Figure 4:
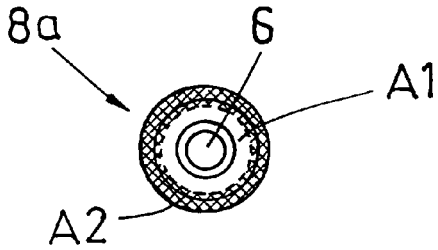
FIG. 4 is a view from the top of the spindle part of the sprinkler in the axial direction of the spindle means.

When the sprinkler is triggered, the spindle means 8 drops to the position in FIG. 3 and the pressure of the medium in the inlet 3 directs a pressure to a projected circular action surface area A1 (the area inside the dashed line in FIG. 4) of the first spindle part 8*a* and through a middle channel 6 of the first spindle part to an annular action surface area A3. In FIG. 4 that shows a top view of the first spindle part 8*a*, the action surface area A1 is the section inside the dashed line. The pressure causes opposing force components to the action surface areas A1 and A3, so the action surface area A3 partly compensates for the force caused by the action surface area A1. The action surface area A1 is selected to be larger than the action surface area A3. If, when the ampoule 1 is triggered, all nozzles 4, 5*a*, 5*b* of the sprinkler are to start spraying when the pressure of the medium exceeds a certain first pressure, for instance 50 bar, the action surface area A1 should be selected to be so much bigger than the action surface area A3 that the force that the first pressure directs to the action surface area A1 is greater than the force that the medium directs to the action surface area A3 added by the force caused by the spring 10. The first spindle part 8*a* then moves to the position in FIG. 2. When moving in relation to the second spindle part 8*b*, a circular additional surface area A2 at the top of the first spindle part 8*a* comes under the pressure of the medium. The additional surface area A2 is the section remaining outside the dashed line in FIG. 4 and causes to the first spindle part 8*a* a force that is parallel with the force of the action surface area A1, which is the area inside the dashed line. The dashed line shows the point, where the top of the first spindle part 8*a* is sealed against a shoulder 19 of the second spindle part 8*b* in the situations in FIGS. 1 and 3. Owing to this, the first spindle part 8*a* remains in the position of FIG. 2 even though the pressure of the medium drops to the second pressure that is significantly lower than the first pressure (50 bar). The size of the additional surface area A2 is selected to be such, for instance, that the channels 9-15-17-14-7*a* and 9-15-17-14-7*b* remain open if other, but the spindle means can be a one-piece component, in which case it is loaded by a spring from below (the direction of the ampoule). However, the two-piece structure of the spindle means makes the sprinkler structure practical. The spindle means need not keep the inlet closed when the sprinkler is in its standby position, but in high-pressure solutions, this is recommended, because great forces that load the sprinkler in its standby position are then not generated. Instead of a helical spring, the spindle means can, in principle, be loaded by any spring means, which means that the term 'spring' in claim 1 refers to any spring means suitable for the purpose, including elastomer members. The surface areas A1, A2 and A3 need not necessarily be circular or annular, even though these forms are highly recommended in view of manufacturing.

What is claimed is:

1. A sprinkler comprising a temperature-activated means (1), a housing (2), an inlet (3) for a medium, a central nozzle (4), at least one side nozzle (5*a*, 5*b*), a first channel (9-15-6-12-13) for guiding the medium from the inlet to the central nozzle while the sprinkler is in its active state, and a second channel (9-15-17-14-7*a*) for guiding the medium from the inlet to said at least one side nozzle (5*a*), the second channel being closed by means of a spindle means (8) while the sprinkler is in a standby state, which spindle means (8), in the sprinkler's standby state, is in a housing channel (14) of the housing in a first position, in which it is arranged to keep the second channel (9-15-17-14-7*a*) closed, and, which spindle means, when the sprinkler is being activated due to the temperture-activating means (1) reacting to heat, is arranged to move to a second position and to open the second channel, wherein the spindle means (8) comprises a first spindle part (8*a*) which, when it is in a first position, is arranged to keep the second channel (9-15-17-14-7*a*) closed while the sprinkler is in its standby state, which first spindle part comprises a first action surface area (A1) that is exposed to pressure of the medium after the temperature-activated means (1) of the sprinkler is triggered and while the sprinkler is in its active state, and which first spindle part (8*a*), when the temperature-activated means of the sprinkler is triggered, is arranged to move against the spring-back force of a spring (10) from the first position to a second position in such a manner that it opens the second channel (9-15-17-14-7*a*) as a result of the medium directing to the first action surface area (A1) at least a first pressure, and that the first spindle part (8*a*) comprises an additional surface area (A2) that is exposed to said at least first pressure of the medium when the first spindle part (8*a*) moves from its first position to its second position, the size of the additional surface area being selected so that it, as a result of the pressure of the medium, keeps the first spindle part in said second position when the pressure of the medium is higher than a second pressure, which second pressure is substantially lower than the first pressure, whereby after the temperature-activated means is triggered, the sprinkler is in a first active state when the first spindle part is in its second position and in a second active state when the first spindle part is in its first position.

2. A sprinkler as claimed in claim 1, wherein the size of the additional surface area (A2) is selected in such a manner that the second pressure is at most 0.8 times the first pressure.

3. A sprinkler as claimed in claim 1, wherein the size of the additional surface area (A2) is selected in such a manner that the second pressure is at most 0.5 times the first pressure.

4. A sprinkler as claimed in claim 1, wherein the size of the additional surface area (A2) is selected in such a manner that the second pressure is at most 0.2 times the first pressure.

5. A sprinkler as claimed in claim 1, wherein the spindle means (8) comprises a second spindle part (8*b*) that is loaded by the spring (10) when the sprinkler is in its standby state, whereby the spring is arranged to direct to the second spindle part a force that is opposite to the force directed to the first spindle part (8*a*).

6. A sprinkler as claimed in claim 5, wherein the second spindle part (8*b*) comprises a spindle channel (15), inside which the first spindle part (8*a*) is arranged and which forms a part of the first channel (9-15-6-12-13), and that the second spindle part (8*b*) is in its first position arranged to close the inlet (3) and to prevent the medium from entering the first channel (9-15-6-12-13) and the second channel (9-15-17-14-7*a*) when the sprinkler is in its standby state, and when the temperature-activated means (1) is triggered, the second spindle part is arranged to move in the housing channel (14) from a first position to a second position in such a manner that the inlet (3) opens and the medium can flow from the inlet through the spindle channel (15) to a middle channel (6) of the first spindle part (8*a*), which middle channel is part of the first channel (9-15-6-12-13).

7. A sprinkler as claimed in claim 6, wherein the second spindle part (8*b*) comprises a sleeve-like part (16) surrounding the middle channel (6) that in the standby state of the sprinkler is arranged to close the inlet (3) and to extend at least nearly equal in diameter in the housing channel (14) to both sides of the inlet (3).

8. A sprinkler as claimed in claim 1, wherein the first spindle part (8*a*) comprises a second action surface area (A3) that comes under the pressure of the medium after the temperature-activated means (1) of the sprinkler is triggered, which second action surface area is smaller than the first action surface area (A1) and which under the effect of the pressure of the medium is arranged to direct a force to the first spindle part, the force being opposite to the force that the pressure of the medium directs to the first action surface area.

9. A sprinkler as claimed in claim 8, wherein the first spindle part (8*a*) comprises as part of the first channel (9-15-6-12-13) a middle channel (6) that leads to the second action surface area (A3) and that leads in the flow direction of the medium to a throttle (12) from which a channel (13) leads to the central nozzle (4), the channel being part of the first channel.

10. A sprinkler as claimed in claim 9, wherein the first spindle part (8*a*) is arranged inside the second spindle part (8*b*) and that the channel is a spiral route (13) defined by the spring (10), whereby the spring is a helical spring (10) arranged around the first spindle part (8*a*).

11. A sprinkler as claimed in claim 1 wherein the first channel (9-15-6-12-13) is closed by means of a closing means (1, 16) when the sprinkler is in its standby state and arranged to open when the temperature-activated means (1) reacts to heat.

12. A sprinkler as claimed in claim 11, wherein the closing means is the temperature-activated means (1).

13. A sprinkler as claimed in claim 11, wherein the closing means is the spindle means (8).

* * * * *